United States Patent [19]

Watanabe

[11] Patent Number: 4,553,327

[45] Date of Patent: Nov. 19, 1985

[54] RULER DEVICE FOR USE IN MARKING-OFF

[76] Inventor: Yosio Watanabe, 389-4, Kuroda Fujinomiya-shi, Shizuoka-ken, Japan

[21] Appl. No.: 595,802

[22] Filed: Apr. 2, 1982

[30] Foreign Application Priority Data

Apr. 15, 1983 [JP] Japan ..... 58-65234

[51] Int. Cl.[4] ..... B43L 13/02

[52] U.S. Cl. ..... 33/32 B; 33/DIG. 1

[58] Field of Search ..... 33/DIG. 1, 174 R, 174 L, 33/26, 32 R, 32 B, 32 C, 18 R, 189, 430

[56] References Cited

U.S. PATENT DOCUMENTS

| | | | |
|---|---|---|---|
| 599,620 | 2/1898 | Meissner et al. | 33/32 B |
| 1,167,543 | 1/1916 | Clendenning | 33/26 |
| 1,624,280 | 4/1927 | Rasmusen | 33/26 |
| 2,001,060 | 5/1935 | Fuchs | 33/403 X |
| 2,813,710 | 11/1957 | Angle | 33/DIG. 1 |
| 3,108,381 | 10/1963 | Kuebler | 33/32 C |

FOREIGN PATENT DOCUMENTS

| | | | |
|---|---|---|---|
| 1206363 | 8/1959 | France | 33/DIG. 1 |
| 0156517 | 9/1982 | Japan | 33/DIG. 1 |
| 45329 | 9/1908 | Switzerland | 33/43 C |

*Primary Examiner*—Harry N. Haroian

*Attorney, Agent, or Firm*—Armstrong, Nikaido, Marmelstein & Kubovcik

[57] ABSTRACT

A ruler device for use in marking-off which comprises a reference rail fixed to a surface table by means of a magnet, an orthogonal rail mounted on the reference rail detachably and shiftably along the reference rail and extending in an orthogonal direction relative to the reference rail, and a shifting table mounted shiftably along the orthogonal rail and being provided with a marking-off pin or scriber.

3 Claims, 5 Drawing Figures

RULER DEVICE FOR USE IN MARKING-OFF

BACKGROUND OF THE INVENTION

This invention relates to a ruler device for use in marking-off in which a marking-off line or a center punching is applied to a work prior to mechanical machining such as boring or the like.

The device of this kind which has been used heretofore is such that like the drafting machine, two pieces of rails which are orthogonal are provided on the drawing board and the marking-off pin is shifted orthogonally in two directions, and the marking-off is carried out.

In this device, since one rail is fixed to the drawing board, the work must be placed on the drawing board so that the center line of the work becomes parallel or perpendicular to the rail. The placing of the work in this manner is extremely difficult in case the work is heavy and must be shifted by a crane. Also, the device itself occupies an extremely large space.

An object of this invention is to eliminate the foregoing inconvenience and to provide a ruler device that can be used easily on a large workpiece and also that does not take up the large space.

Namely, the ruler device of this invention is such that the rail is independently provided separate from the drawing board, and the rail is fixed to the surface table that is already installed by means of a magnet, and a proper positional relation of the rail and the work placed on the surface table is obtained by shifting the rail, and furthermore, two pieces of the rails are mutually separatable and when it is not used, it is disassembled so as to be stored in a small space.

BRIEF DESCRIPTION OF THE DRAWINGS

The drawings show an embodiment of this invention.

DETAILED DESCRIPTION OF THE INVENTION

Figure 1:
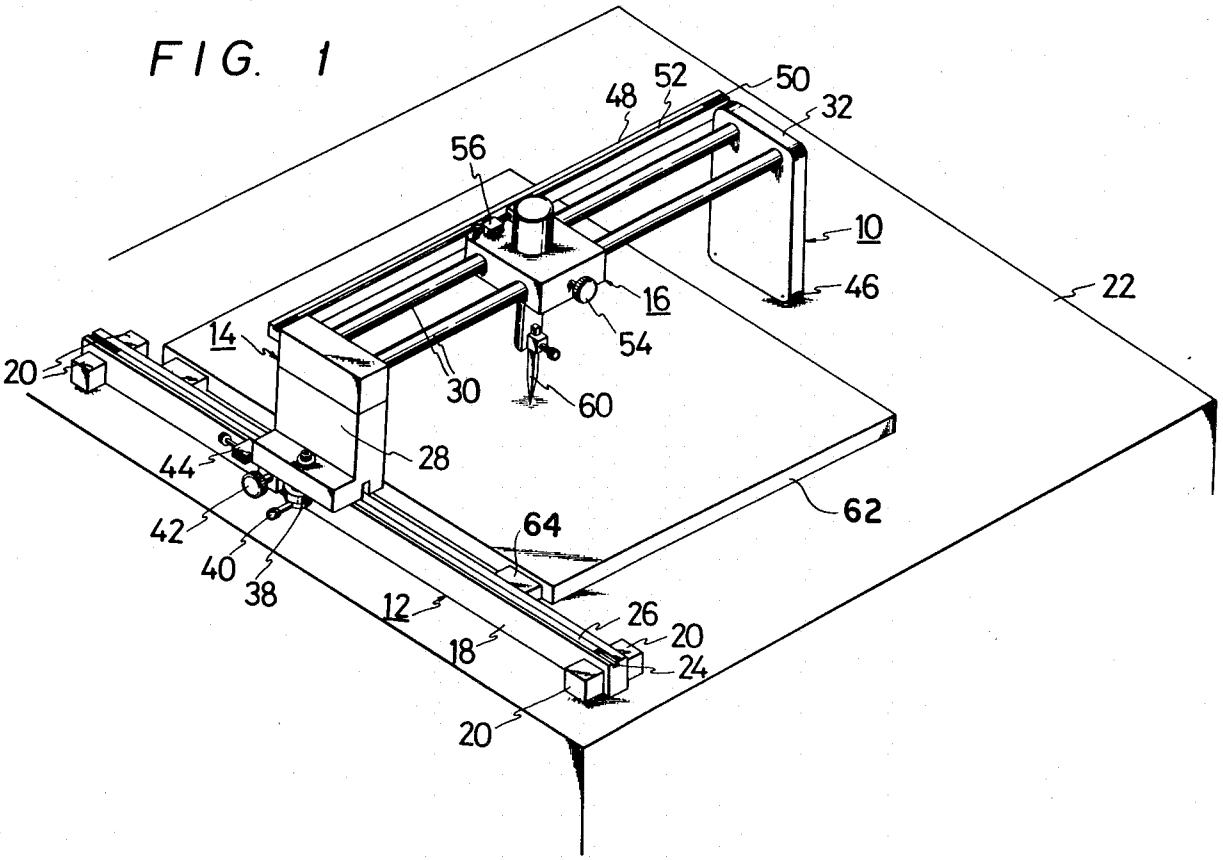
FIG. 1 is a perspective view.
Figure 2:
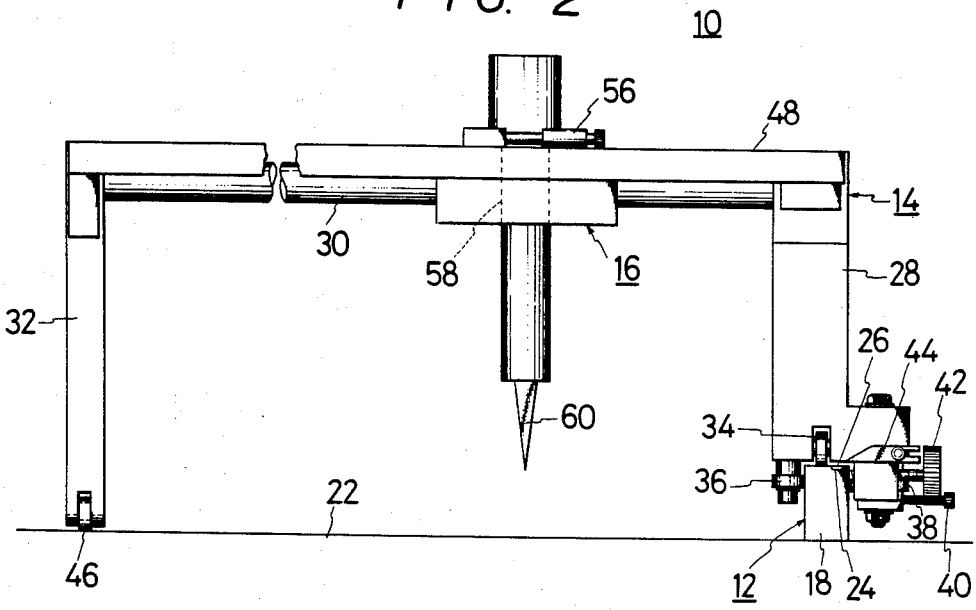
FIG. 2 is an elevation.
Figure 3:
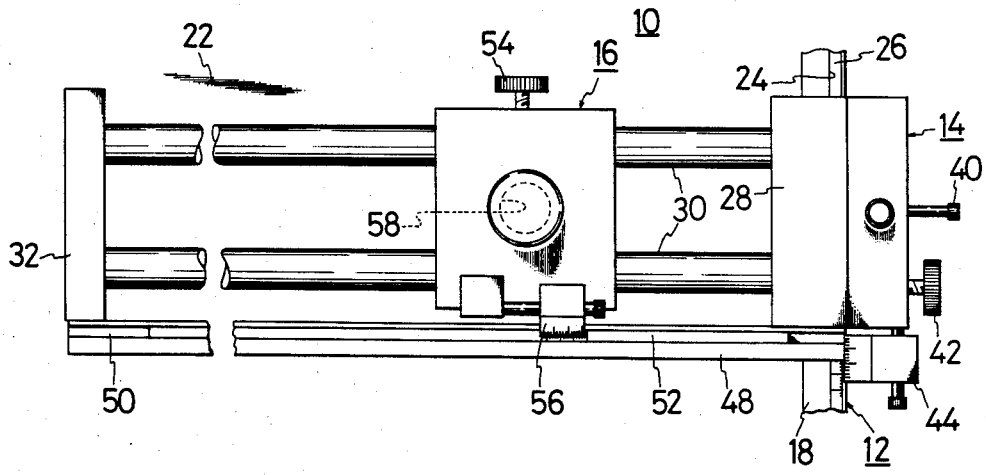
FIG. 3 is a view.
Figure 4:
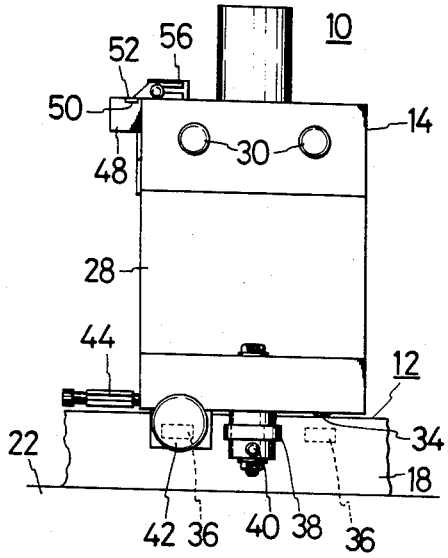
FIG. 4 is a right side view.
Figure 5:
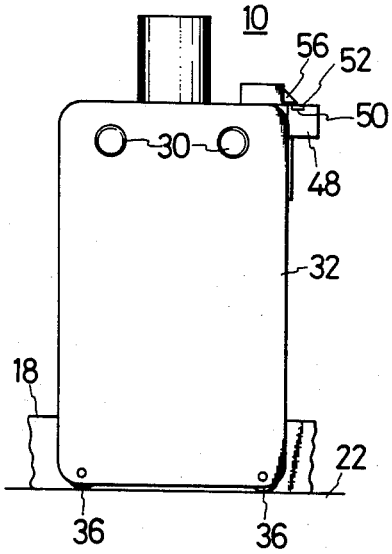
FIG. 5 is a left side view.

This invention will be described concretely by referring to an embodiment illustrated in the drawings.

Reference numeral 10 denotes a ruler device, and is composed of a reference rail 12, orthogonal rail 14, and shifting table 16. The reference rail 12 is composed of an iron made bar 18 having a rectangular cross section, and is fixed to a surface table 22 by means of a magnetic block 20.

A concave groove portion 24 is formed on the upper surface of the bar 18, and a scale 26 made of the magnetic tape is fitted to the concave groove portion and is magnetized.

The orthogonal rail 14 is composed of a coupling portion 28, rail portion 30, and an end portion 32. The coupling portion 28 is mounted on the bar 18 so as to be shiftable along the reference rail 12 by a roller 34 in contact with the upper surface of the bar 18 of the reference rail 12 and the side portion of the concave groove portion 12, and rollers 36, 36, 38 sandwiching the bar 18 from both sides. The first roller 38 sandwiching the bar 18 can be separated from the bar 18 by the operation of a lever 40, and the coupling portion 28 can be removed from the bar 18 by the foregoing separating operation. Reference numeral 42 denotes a screw dial, and is provided in the lower portion of the coupling portion 28, and the tip pushes the bar 18 by the rotation of the screw dial, and is capable of fixing the coupling portion 28 to the bar 18. Reference numeral 44 denotes a vernier mounted on the coupling portion 28, and reads a graduation of a scale 26. The rail portion 30 is composed of two pieces of round bars, and extends from the coupling portion 28 so as to be orthogonal relative to the reference rail 12, and reaches the end portion 32. The end portion 32 has rollers 46 and 46 contacting a surface table 22 at its lower end. Reference numeral 48 denotes a scale bar, and is a bar made of iron, and extends in parallel to the rail portion 30 as it is mounted on the coupling portion 28 and the end portion 32. A concave groove portion 50 is formed on the upper surface of the scale bar 38, and a scale 52 made of the magnetic tape is fitted to the concave groove portion and is magnetized.

The shifting table 16 is fitted to the rail portion 30 of the orthogonal rail 14, and can be shifted along the rail portion 30. Reference numeral 54 denotes a screw dial, and is provided on the side of the shifting table 16, and its tip pushes the round bar of the rail portion 30 by the rotation of the screw dial 54, and fixes the shifting table 16 to the rail portion 30. Reference numeral 56 denotes a vernier mounted on the shifting table 16, and reads a graduation of the scale 52. Reference numeral 58 denotes a mounting hole for the marking-off pin, and is provided in the center of the shifting table 16. In this drawing, a marking-off pin 60 is mounted in the mounting hole 58.

Reference numeral 62 denotes a work, and numeral 64 denotes a rectangular block interposed between the work 62 and the reference rail 12.

This ruler device 10 has the foregoing construction so that it can be used in the following manner. In the first place, the work 62 is placed on the surface table 22, and the block 64 is abutted on its side surface, and then, the reference rail 12 is abutted thereon, and the reference rail 12 is placed parallel to the side of the work. Next, magnetic blocks 20, are abutted on the side of the reference rail 12, and the reference rail 12 is fixed to the surface table 22 by the magnetic force thereof. Next, the orthogonal rail 14 is mounted on the reference rail 12 by placing the coupling portion 28 on the reference rail 12 and urging the roller 38 against the bar 18 by operating the lever 40. Next, the marking-off pin 60 is abutted to the position that becomes the standard such as the center point of the work 62, and the scales 26, 52 are shifted in the concave groove portions 24 and 50 so that the numerical value of the scale to be read by the verniers 44, 56 becomes the round number such as 150 mm unit or the like. Thereafter, the desired line is drawn according to the work 62. At this time, if necessary, the screw dials 42 and 54 are used to fix the orthogonal rail 14 or the shifting table 16.

If the center punch instead of the marking-off pin 60 is mounted in the mounting hole 58 of the shifting table 16 at this time, the punching can be applied directly by omitting the marking-off work, and also, when the drill is mounted, the prepared hole of the work can be bored.

When the operation is completed, and the orthogonal rail 14 is removed from the reference rail 12 by operating the lever 40, and the reference rail is removed from the surface table 22, both rails 12 and 14 are set in parallel and can be stored in a narrow space.

In the foregoing embodiment, in order to fix the reference rail 12 to the surface table 22, the magnetic block 20 is supposed to be abutted from the outside, but the magnet may be built in the reference rail.

Also, the structures of the reference rail, orthogonal rail, coupling portion or the like are not limited to the foregoing, and other structures may be employed. However, when the reference rail is made to have the rectangular cross section like the foregoing embodiment, the structure becomes not only simplified but also the use of the block 64 or the direct abutment of the work become possible when the reference rail is placed in parallel to the side of the work, and as the result, the operation becomes easy, and is convenient.

Although the scale is not limited to the structure of the foregoing embodiment, the easy handling becomes possible when the structure of the foregoing embodiment is employed. Also, when the scale and the vernier are changed to the linear encoder and the digital display unit, the easier handling becomes possible and in case swinging the desired distance from the center line to both sides, the computation is not required.

The ruler device of this invention that is obvious from the foregoing can be used easily for the heavy work since the reference rail can be placed by matching the work. Also, when not used, it can be disassembled to be stored in a narrow space which is extremely convenient.

What is claimed is:

1. A ruler device for use in marking-off a workpiece comprising:

(a) a reference rail which is a straight iron bar having a rectangular cross section and a top surface relieved to form a concave groove;

(b) a coupling device mounted upon said reference rail, comprising a body having a top portion, a middle portion and a base portion, said base portion bearing rollers located so as to contact the top surface and both side surfaces of said reference rail;

(c) support rails inserted into the top portion of said coupling device orthogonal to the reference rail, and parallel to each other;

(d) a scale bar, inserted into the top portion of said coupling device and parallel to said rails, being of rectangular cross section and bearing a concave groove upon its upper surface;

(e) a support member attached at or near one of its end to the ends of the support rails and scale bar opposite said coupling device, lying in the same plane as said coupling device, having at an end opposite to the attachment to said support rails one or more rollers and being of a length such that, when the reference rail rests upon a plane surface, the support rails will be held parallel to said plane surface;

(f) a shifting table slidably mounted upon said support rails, having a tool mount essentially in the center and bearing a device for moving said table in the plane of said support rails;

(g) magnetic tapes fitted into the grooves in the top portions of said reference rail and said scale bar, said magnetic tapes bearing identifiable markings at regular intervals across their lengths;

(h) identifying devices mounted upon the base portion of said coupling device and upon said shifting table, said identifying devices being suitable to determine the location of said coupling device and said shifting table relative to said magnetic tape portions; and (i) magnets which attach to said reference rail and hold said reference rail firmly to a ferrous metal surface.

2. The ruler device according to claim 1, wherein the identifying device is a vernier scale and the magnetic tape is marked with visible lines.

3. The ruler device according to claim 1, wherein the identifying device is a digital display unit and the magnetic tape is a linear encoder.

* * * * *